United States Patent [19]

Wakamiya et al.

[11] 4,394,121

[45] Jul. 19, 1983

[54] METHOD OF CONTROLLING CONTINUOUS REHEATING FURNACE

[76] Inventors: Yoshinori Wakamiya, Nishinomiya; Yoshiharu Hamasaki, Takarazuka; Masaki Kutsuzawa, Kobe, all of Japan; Mitsubishi Denki Kabushiki Kaisha, 03, Tokyo, Japan

[21] Appl. No.: 311,331

[22] Filed: Oct. 14, 1981

[30] Foreign Application Priority Data

Nov. 8, 1980 [JP] Japan ..... 55-158387
Nov. 12, 1980 [JP] Japan ..... 55-159974

[51] Int. Cl.[3] ..... F27D 3/00; F27B 9/40; C21B 7/24

[52] U.S. Cl. ..... 432/11; 266/80; 432/18; 432/37

[58] Field of Search ..... 432/11, 18, 37, 24; 266/80

[56] References Cited

U.S. PATENT DOCUMENTS 3,604,695 9/1971 Steeper ..... 266/80
4,255,133 3/1981 Tanifuji et al. ..... 432/24

FOREIGN PATENT DOCUMENTS 55-49140 12/1980 Japan .

*Primary Examiner*—John J. Camby
*Attorney, Agent, or Firm*—Wenderoth, Lind & Ponack

[57] ABSTRACT

A control method comprises predetermining a or presuming a fuel flow rate for each of three control zones of a continuous slab reheating furnace, predicting each slab temperature after a plurality of time intervals from the presumed fuel flow rate, and controlling the fuel flow rate for each zone so as to minimize the sum of the differences between the predicted temperatures and corresponding objective temperature rise curves for all the slabs. Alternatively, the method may comprise sensing flow rates of the fuel and air for each zone at time intervals Δt, calculating the temperature profile within the furnace and then the temperature of each slab at the present time point from the sensed flow rates, repeating the calculations with the calculated slab temperature and any presumed fuel flow rate for each zone to predict the temperature profile within the furnace and each slab temperature after Δt, determining the fuel flow rate so as to render the differences between the predicted and the objective temperatures of each slab smaller than a predetermined value and controlling the fuel flow rates following the parameters thus determined.

1 Claim, 6 Drawing Figures

METHOD OF CONTROLLING CONTINUOUS REHEATING FURNACE

BACKGROUND OF THE INVENTION

This invention relates to a method of controlling a continuous reheating furnace for heating slabs or the like.

When the heating of continuous slab reheating furnaces is controlled, it is generally required to heat uniformly slabs to a temperature suitable for rolling them and simultaneously heat the slabs to the required final temperature in accordance with a speed required for their rolling line following the continous reheating furnace.

In the control of the type referred to, it has been heretofore the procedure to control the temperature of the atmosphere disposed within continous reheating furnaces to a single value set uniformly in a plurality of control zones into which the furnace is divided. This is because it is extremely difficult to control temperature of a multitude of slabs different in loading, for example, which differ in size from one another respectively resulting in the employment of a single temperature in spite of the differences in the loading or size of the slabs.

In order to maintain the control of the delivery temperatures of slabs by an electronic computer there have been known control methods of the type calculating the heat transfer between a continuous reheating furnace involved with a heating atmosphere and slabs heated therein from a measured temperature profile within the furnace and controlling the flow rate of a fuel introduced into the furance so as to set the temperature of the atmosphere so as to correspond to an objective value determined by the result of the heat transfer calculation.

Those known control methods have been disadvantageous in that the measured temperature profile is very poor in accuracy because of the small number of thermometers for measuring the temperatures within the furnace, which theremomethers do not necessarily indicate the correct temperatures within the furnace. This is because the thermometers are apt to be affected by associated burners, and that the delivery temperature of the slabs is poor in accuracy because the actual temperature within the furnace reaches the objective value with a time delay.

Accordingly it is an object of the present invention to provide a novel and improved method of controlling the heating of a continuous reheating furnace with a high accuracy.

SUMMARY OF THE INVENTION

According to one aspect thereof, the present invention provides a method of controlling continuous reheating furnaces, comprising the steps of presuming a flow rate of a fuel introduced into each of a plurality of control zones into which a continuous reheating furnace is divided, predicting the temperature of each of the slabs within the furnace after any time interval, finding the difference in each slab between the predicted temperature and an objective temperature rise curve and determining the flow rate of the fuel introduced into each of the control zones so as to minimize the sum of the squares of the differences in all the slabs multiplied by respective factors.

According to another aspect thereof, the present invention provides a method of controlling a continuous reheating furnace comprising the steps of sensing the flow rates of a fuel and air introduced into each of a plurality of control zones into which a continuous reheating furnace is divided, at each of any time points, determining the temperature profile within the furnace up to the present time point by using means for determining a change in the temperature profile within the furnace with respect to the time from the flow rates of the introduced fuel and air, finding the temperature of each of slabs at the present time point by using the temperature profile within the furnace determined at the present time point, predicting a future change in the temperature of the furnace on the basis of the found temperature of the slabs and the flow rate of the fuel introduced into each control zone of the furnace and set at will by using the temperature change determining means, determining the predicted slab temperatures by using the predicted furnace temperature, determining the flow rate of the fuel introduced into each of the control zones so as to render the differences between the predicted slab temperature and the objective slab temperature not greater than a predetermined value, and controlling the flow rate of the introduced fuel following an objective value formed of the flow rate of the fuel now determined.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Any continuous reheating furnace for heating slabs is divided into a plurality of control zones and has a temperature within the i-th control zone expressed by $$T_{gi}=f_i(\Delta t, G_1, G_2, \ldots, G_n, T_{g1}^{\circ}, T_{g2}^{\circ}, \ldots, T_{gn}^{\circ}, T_{s1}, T_{s2}, \ldots, T_{sm}) \quad (2)$$

where i: any integer between 1 and n identifying associated control zone $T_g$: gas temperature before a time interval $\Delta t$ $T_2$: temperature of slab G: flow rate of fuel n: number of control zones and m: number of slabs to be heated The expression (1) describes the gas temperature within the i-th control zone and the temperature of the j-th slab may be expressed by $$T_{sj}=g_j(\Delta t, T_{g1}, T_{g2}, \ldots, T_{gn}, T_{sj}^{\circ}) \quad (2)$$

where

Figure 1:
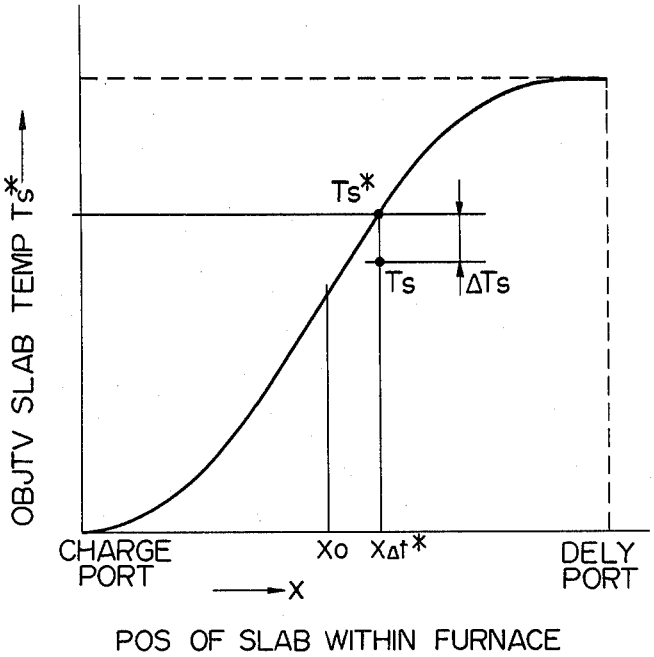
FIG. 1 is a graph illustrating an objective temperature rise curve for a slab.

Δ: any integer between 1 and m identifying associated slab and $T_s^{\circ}$: slab temperature before the time interval Δt According to one aspect thereof, the present invention is characterized in that, at any time point the temperature of the j-th slab $T_{sj}^*$ is predicted by alternately repeating the expressions (1) and (2) and the flow rate of the fuel introduced into each control zone is determined so as to minimize the sum of deviations of the predicted slab temperatures from the corresponding objective temperature rise curves one of which is shown in FIG. 1, wherein the axis of ordinates represents an objective temperature $T_s^*$ of a slab and the axis of abscissa represents the position of the slab moved within an associated continuous reheating furnace from its charge to its delivery port. In FIG. 1, a slab (not shown) is described as having the actual temperature $T_s$ at its position $x_{66\,t}^*$ less than it is objective temperature $T_s^*$ by $\Delta T_s$.

Figure 2:
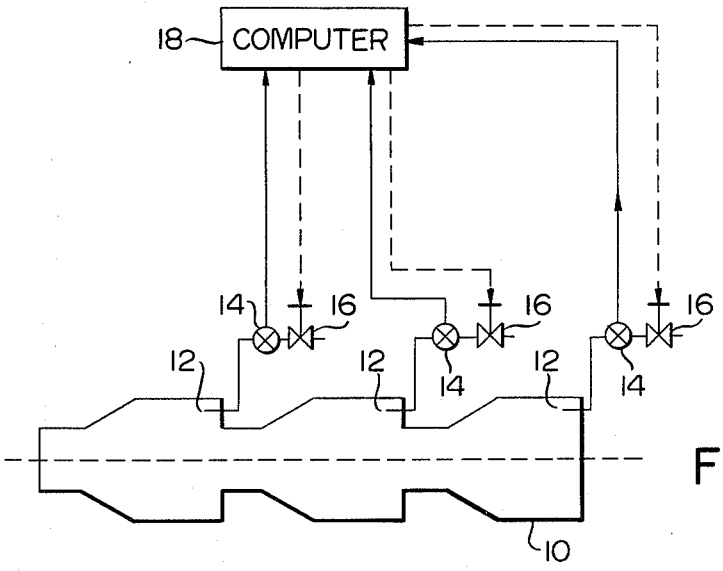
FIG. 2 is a schematic view of a continuous reheating furnace controlled by one embodiment according to the control method of one aspect of the present invention.

FIG. 2 shows schematically a continuous reheating furnace controlled in accordance with the control method of one aspect of the present invention. The arrangement illustrated comprises a continuous reheating furnace 10 shown as being divided into three control zones, one burner 12 open at the down stream end of each control zone in a direction of transport of slabs (not shown) for burning a fuel, a fuel flow meter 14 connected to the associated burner 12 and a fuel flow control valve 16 connected to the associated fuel flow meter 14. Then all the fuel flow meters 14 are connected to an electronic computer 18 subsequently connected to all the fuel flow control valves 16.

In operation the computer 18 sets the flow rate of the fuel introduced into each control zone at some time intervals Δt. More specifically, the computer 18 determines the temperature of each slab (not shown) at the present time point on the basis of the mean actual fuel flow rate measured during the time interval Δt by the associated fuel flow meter 14 in each control zone. The gas temperature profiles within the furnace and the slab temperature profiles are determined by the just preceding calculation and by alternately repeating the expressions (1) and (2) at predetermined incremental time intervals $\Delta t_1=\Delta t/N_1$ where $N_1$ is an integer having a value of not less than unity (1).

Then the computer 18 predicts the gas temperature profile and each slab temperature after a future time interval $\Delta t_2=N_2\Delta t$, where $N_2$ is an integer whose value is not less than unity (1), according to the calculations described above by using the gas temperature profile within the furnace and each of the slab temperatures now calculated at the present time point, as the initial values, and presuming the flow rate of the fuel introduced into each control zone.

Subsequently the computer 18 predicts the position $x_{\Delta t}^*$ (FIG. 1) of each slab after the time interval $\Delta t_2$ from the present position $x_o$ (FIG. 1) thereof and data for slab transport and also finds the objective slab temperature $T_{sj}^*$ of each slab after the time interval $\Delta t_2$ from the objective temperature rise curve for each slab as shown in FIG. 1 stored in the computer 18.

Following this, by using the predicted and objective slab temperatures $T_{sj}$ and $T_{sj}^*$ respectively, the computer 18 determines a deviation index $J_n$ following $$J_n = \sum_{j=1}^{m} \alpha_j(T_{sj}^* - T_{sj})^2 \quad (3)$$

where $\alpha_j$ designates a weighting coefficient for the j-th slab.

Finally, the computer 18 determines the flow rate of the fuel introduced in each control zone so as to minimize the deviation index $J_n$. The minimum value of the deviation index $I_n$ may be calculated according to an optimizing method well known in the art, for example, the steepest descent method.

When the computer 18 has completed the calculations as described above, the computer applies the flow rates thus determined to the associated fuel flow control valves 16 to control flow rates of the fuel introduced into the mating control zones.

From the foregoing it is seen that, according to one aspect thereof, the present invention provides a method of controlling a continuous reheating furnace thereby making it possible to control the delivery temperatures of slabs, which are different in loading; such as in dimensions, from one another, with a high accuracy.

According to another aspect thereof, the present invention contemplates a method of eliminating the disadvantages of the conventional methods of the type controlling the flow rate of a fuel introduced into a continuous slab reheating furnace so as to set the gas temperature therein to the objective temperature of the furnace determined by calculating the heat transfer between the furnace and slabs on the basis of the actual gas temperature therein by an electronic computer.

Figure 3:
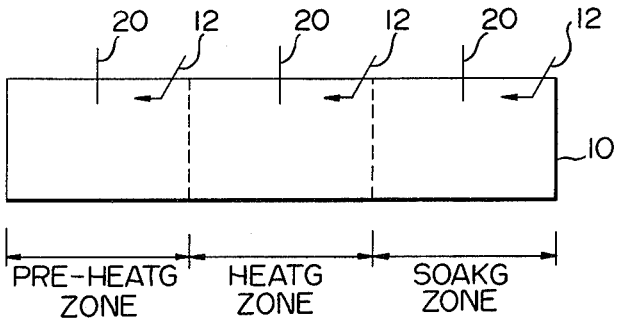
FIG. 3 is a schematic view illustrated a model of a continuous reheating furnace useful in explaining the prior art presumption of a temperature profile within the furnace.
Figure 4:
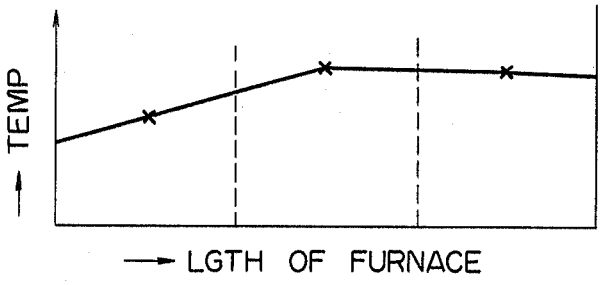
FIG. 4 is a graph illustrating a temperature profile presumed by the arrangement shown in FIG. 3.

A conventional control method of the type referred to will now be described in conjunction with FIG. 3 wherein there is illustrated a model of a continuous slab reheating furnace. As shown in FIG. 3, the reheating furnace 10 is divided into a preheating, a heating and a soaking zone, which are heated through the combustion of fuel portions introduced thereinto from three burners 12, one for each zone, disposed on the downstream side in a direction of transport of slabs (not shown). The conventional control method has been to use one thermometer 20 substantially centrally disposed in each zone to measure the gas temperature within the furnace 10. This has resulted in a temperature profile of the gas within the furnace, as shown in FIG. 4 wherein the axis of ordinates represents the measured temperature and the axis of the abscissas represents the axial position of a slab (not shown) within the furnace with the a measured point designated by the "cross" symbol. The temperature profile is drawn by interconnecting the three measured points one for each zone.

In the above procedure, an electronic computer has determined the temperature of each slab at every position within the furnace between its charge and its delivery port for the slabs by calculating the heat transfer from the size of each slab and the time interval for which the slab has actually stayed in the furnace up to each calculation time point on the basis of the measured temperature profile of the gas. The computer further predicts the time interval for which each slab still remains in the furnace till its delivery from the furnace, according to a delivery schedule thereof, and calculating back to find the gas temperature of the atmosphere within the furnace required for the slab to be heated to an objective delivery temperature.

Then the flow rate of the fuel introduced into the furnace has been controlled so as to set the actual temperature of the gas within the furnace to the required value of the gas temperature thus calculated.

Conventional control methods, such as described above, have been disadvantageous in the following respects: The temperature profile required for the calculation of the heat transfer is very poor in accuracy because it is based upon the use of a small number of measuring points, for example, a single measuring point for each zone as shown in FIG. 2. Alternatively, at most, two measuring points might be used for each zone. Thus it has been difficult to determine the true temperature conditions of the furnace in an exact manner.

Also, the thermometer used in the conventional furnace is apt to be affected by the flame from the associated burner so that it does not always indicate the accurate temperature of the gas within the furnace.

Further as the computer calculates backward to find the temperature within the furnace required for the slab to be heated to the desired delivery temperature, the actual temperature within the furnace reaches the calculated value only after some time delay. This has resulted in a poor accuracy with which the slab is heated to the objective delivery temperature.

In order to eliminate the disadvantages of the prior art practice as described above, the heating control method of the present invention comprises, according to another apsect thereof, the steps of calculating a temporal change in the temperature profile within a continuous reheating furnace with given flow rates of fuel and air introduced into the furnace; predicting the temperatures of each slab at a present time point and in a future time point by using the calculated temporal change in the temperature profile; predicting the flow rate of the introduced fuel so as to set the difference between the predicted temperature of each slab and an objective temperature thereof to not greater than a predetermined value, and controlling the flow rate of the fuel by using the predicted flow rates as the objective value thereby to heat the slabs following an objective temperature rise curve.

Figure 5:
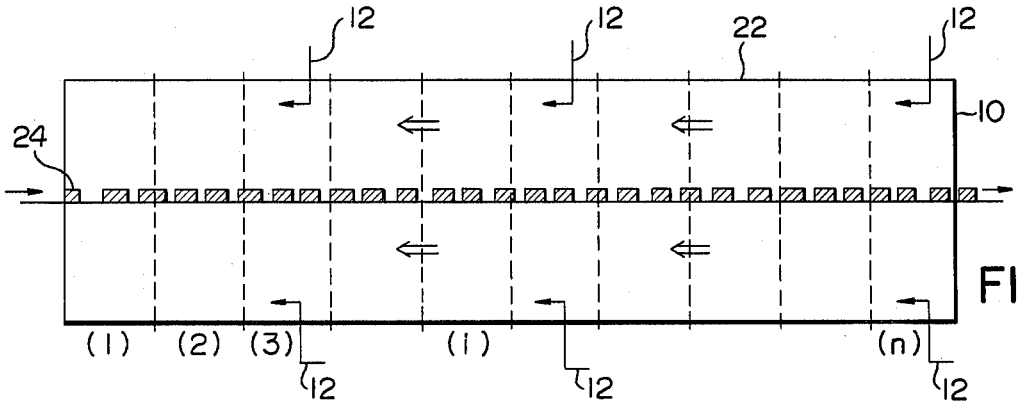
FIG. 5 is a schematic view illustrating a model of a continuous reheating furnace and useful in explaining a calculation of a temperature profile within the furnace according to another aspect of the present invention.

The above heating control method will now be described in detail with reference to FIG. 5, wherein there is illustrated a model of a continuous reheating furnace. The furnace is designated by the reference numeral 10 and surrounded by a wall 22. Also the furnace 10 is divided into n meshes in a longitudinal direction thereof and a pair of top and bottom burners 12 are disposed in each of selected ones of the meshes adjacent to the downstream end in a direction of transport of slabs to be substantially aligned with each other in a direction perpendicular to the longitudinal axis of the furnace 10 as shown typically by those burners located in the third, (i+1)-th and n-th meshes. Slabs to 24 are successively charged into the furnace 10 through its charge port on the lefthand end wall as viewed in FIG. 5 of the furnace 10 and transported through the furnace 10 along the longitudinal axis while being heated with combustion gases from the respective burners 12 flowing in counter current relationship with a stream of the transported slabs 24 through the furnace 10. Then the heated slabs 24 are delivered from the furnace 10 through its delivery port or the righthand end thereof as viewed in FIG. 5.

A temperature profile within the furnace 10 is determined in the following manner:

Relating to each mesh, for example, the i-th mesh, the equation of the thermal equilibrium may be expressed by $$C_1 \frac{dT_{gi}}{dt} = Q_i + H_g \cdot W_i + G_{i+1} \cdot C_{pg} \cdot T_{gi+1} - G_i \cdot C_{pg} \cdot T_{gi} + \sum_{j=1}^{n} K_{1ij}\{T_{gj} + 273)^4 - (T_{gi} + 273)^4\} + \sum_{k=1}^{n} K_{2ik}\{T_{wk} + 273)^4 - (T_{gi} + 273)^4\} + \sum_{l=1}^{m} K_{3il}\{T_{sl} + 273)^4 - (T_{gi} + 273)^4\} + C_2(T_{wi} - T_{gi}) + C_3(T_{si} - T_{gi}) \text{ for } i = 1, 2, \ldots, n \quad (4)$$

where $T_g$: gas temperature $T_w$: wall temperature $T_s$: slab temperature $dT_{g1}/dt$: change in gas temperature relative to time t $Q_i$: sensible heat applied to i-th mesh due to combustion of fuel and air $H_g$: heating value for unit flow rate of fuel $W_i$: flow rate of fuel introduced into i-th mesh $G_i$: flow rate of exhausted gas from i-th mesh $C_{pg}$: specific heat of gas $K_{1ij}$: coefficient of radiation exchange between i-th and j-th meshes $K_{2ik}$: coefficient of radiation exchange between i-th mesh and wall portion surrounding k-th mesh $K_{3il}$: coefficient of radiation exchange between i-th mesh and l-th slab and $C_1$, $C_2$ and $C_3$: constants Also the sensible heat $Q_i$ may expressed by $$Q_i = W_i \cdot C_{pf} \cdot T_f + A_i \cdot C_{pa} \cdot T_a \quad (5)$$

where $A_i$: flow rate of air introduced into i-th mesh $C_{pf}$: specific heat of fuel $C_{pa}$: specific heat of air $T_f$: fuel temperature and $T_a$: air temperature Further the flow rate of exhausted gas $G_i$ may be expressed by $$G_i = \sum_{j=1}^{n} [W_i\{G_o + A_o \mu(j-1)\}] \quad (6)$$

where $G_o$: theoretical quantity of exhaust gas per unit flow rate of fuel $A_o$: theoretical quantity of air per unit flow rate of fuel and $\mu$: excess air factor expressed by $$\mu = A_o \cdot W_i / A_i \quad (7)$$

where $A_i$: flow rate of air introduced into i-th mesh

In the equation (4) the lefthand side designates a change in the gas temperature during the incremental time interval dt while in the righthand side; the second term designates the heating value of the fuel, and the third term designates the quantity of heat of the exhausted gas from the (i+1)-th mesh entered into the i-th mesh. Also the fourth term designates the quantity of heat of the exhausted gas from the i-th mesh entered into the (i−1)-th mesh; the fifth term the quantity of radiant heat entered into the i-th mesh from the remaining meshes; and the sixth term designates the quantity of radiant heat from the wall entered into the i-th mesh. Further, the seventh term designates the quantity of radiant heat from m slabs entered into the i-th mesh; the eighth term represents the quantity of heat due the convection occurring between the i-th mesh and the wall portion surrounding that mesh; and the ninth term designates a quantity of heat due to the convection occurring between the i-th mesh and the slabs located therein.

For the given flow rates of the introduced fuel and air, the equations (4) may be reduced to n simultaneous nonlinear differential equations expressed by $$\frac{dT_{gi}}{d_t} = \sum_{j=1}^{n} A_{ij}(T_{gj} + 273)^4 + \sum_{k=1}^{n} B_{ik}T_{gk} + C_i \quad (8)$$

for $i = 1, 2, \ldots, n$ where $$A_{ij} = K_{1ij} \text{ for } i \neq j$$

$$= K_{1ij} + \sum_{k=1}^{n} K_{2ik} + \sum_{l=1}^{m} K_{3il} \text{ for } i = j$$

$$B_{ik} = 0\ (K \neq i, K \neq i+1) \text{ for } K \neq i, K + j + 1$$

$$= G_k \cdot C_{pg}\ (K = i+1) \text{ for } K = i+1$$

$$= -(G_g \cdot C_{pg} + C_2 + C_3)\ (K = i) \text{ for } K = i$$

and $$C_i = Q_i + H_g \cdot W_i + \sum_{k=1}^{n} K_{2ik}(T_{wk} + 273)^4 + \sum_{l=1}^{m} K_{3il}(T_{sl} + 273)^4 + C_2T_{wi} + C_3T_{si}$$

by using the just preceding temperatures of the furnace and slabs as the boundary conditions. If those nonlinear differential equation are rendered discrete, with respect to time, starting with the just preceding temperature profile of the gas and then converged with respect to time according to Newton method or the like, it is then possible to determine the new temperature profile of the gas.

Once the temperature profile of the gas has been determined as described above, the temperature of the slabs can be determined by substituting that temperature profile into the well known difference equations of heat transfer concerning the slabs and the wall of the furnace. Then, by alternately solving the equations concerning the gas temperature and those concerning the slabs and the wall of the furnace, it is possible to calculate the changes in both the temperature profile within the furnace and slab temperatures with respect to time at every moment.

Figure 6:
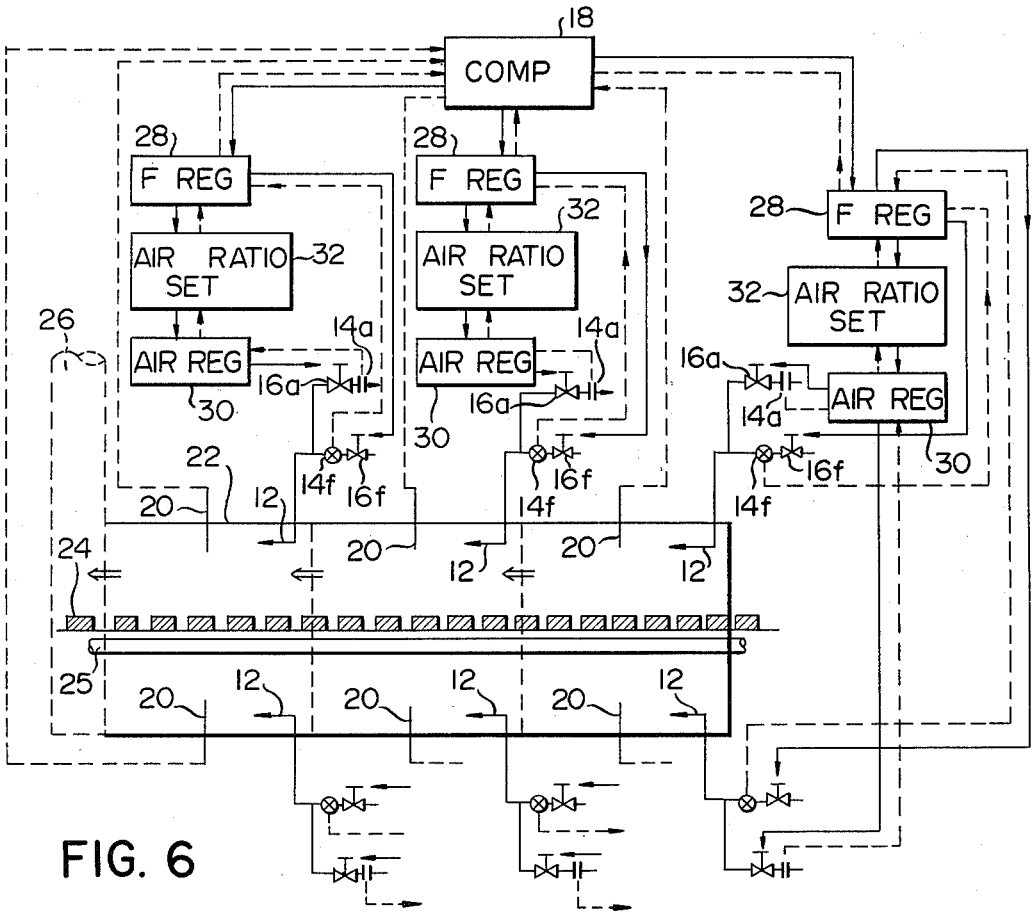
FIG. 6 is a schematic view of a continuous reheating furnace controlled in accordance with an embodiment according to the control method of the present invention using the calculation of the temperature profile within the furnace as described in conjunction with FIG. 5.

Referring to FIG. 6, there will now be described the heating control method of the present invention using the abovementioned determination of the temperature profile of the gas within the furnace. The arrangement illustrated comprises a continuous reheating furnace 10, including a wall 22 and divided into three control zones such as shown in FIG. 3. Disposed in each of the control zones includes therein are a pair of top and bottom burners 12 disposed in the same manner as described above in conjunction with FIG. 5 and also a pair of top and bottom thermometers 20 centrally located to be substantially aligned with each other perpendicularly to the longitudinal axis of the furnace 10. Further an exhaust pipe 26 is connected to the lefthand end as viewed in FIG. 6 of the furnace 10 to permit the exhaust of combustion gases from the burners 12 flowing in counter current relationship with the stream of transport of slabs 24 extending from the lefthand to the opposite end of the furnace 10 along the longitudinal axis and above a skid pipe 25. The combustion gases are exhausted through an exhaust pipe 26 connected to the furnace 10 at the lefthand end as viewed in FIG. 6.

Each of the burners 12 disposed in each zone is connected to a fuel flow meter **14*f* subsequently connected to a fuel flow control valve 16*f* as in the arrangement of FIG. 2 and further to an air flow meter 14*a* through an air flow control valve 16*a*. The fuel flow meter 14*a* is connected to an input to a fuel flow regulator 28 including an output connected to the fuel flow control valve 16*f*. The fuel flow regulator 28 is then connected in two ways to an electric computer 18**.

On the other hand, the air flow meter **14*a* is connected to an input to an air flow regulator 30 including an output connected to the air flow control valve 16*a*. The air flow regulator 30 is connected in two ways to an air setting device 32 subsequently connected in two ways to the fuel flow regulator 28**.

Further all thermometers 20 are connected to the electronic computer 18.

In operation, the regulators 28 and 30 supply respective operating signals to the control valves **16*f* and 16*a* to control valve the opening degrees thereof in order to regulate the flow rates of the fuel and air supplied to the associated burners 12. The fuel and air flow meters 14*f* and 14*a* respectively sense always the flow rates of the fuel and air supplied to the associated burner 12 and supply the sensed flow rate signals back to the fuel and air flow regulators 28 and 30 respectively. The electronic computer 18 receives all the sensed flow rate signals to calculate at predetermined equal time intervals Δt the temperatures as described above in conjunction with FIG. 5, thereby determining the flow rate of the fuel introduced into each control zone. Then a setting signal for the fuel flow rate, thus determined, is applied to to the associated fuel flow meters 14*a*** for each of the control zones.

More specifically the computer 18 calculates, alternately, the gas temperature profile and the slab temperatures up to the present calculating time point at incremental time intervals $\Delta t_1 = \Delta t/N_1$ where $N_1$ is an integer whose value is not less than unity (1) according to the process as described above and on the basis of the mean actual flow rate of the fuel $\overline{W}_i$ (where i identifies the control zone and in this case any one of 1, 2 and 3, that of air $\overline{A}_i$ during the time interval Δt as well as the temperatures of the furnace, slabs and the furnace walls determined just before that time interval, Δt and determines the gas temperature profile and slab temperatures every moment.

Then the computer determines the flow rate of the fuel introduced into each control zone of the furnace during the next succeeding time interval Δt as follows:

By using the gas temperature profile and slab temperatures calculated at the present time point as the initial values and by predetermining or presuming the flow rates of the fuel and air introduced into the furnace during that time interval $\Delta t$, the computer predicts the gas temperature profile and slab temperatures after a time interval $\Delta t_2 = N_2 \Delta t$ (where $N_2$ is an integer whose value is not greater than unity (1)) at incremental time intervals $\Delta t_3 = \Delta t_2 / N_3$ (where $N_3$ is an integer having a value not less than unity (1)), according to the process as described above. Subsequently the presumed flow rate of the fuel is changed so as to decrease the differences between the predicted slab temperatures and corresponding objective slab temperatures. This prediction of the slab temperatures is repeated until the differences between the predicted and objective slab temperatures are less than a predetermined value. The flow rate of the fuel presumed at that time gives the flow rate of the fuel introduced into the furnace during the next succeeding time interval as described above.

Upon the completion of the calculation as described above, the computer 18 applies a setting signal for the flow rate of the introduced fuel thus determined to the associated fuel flow regulators 28. Each of the fuel flow regulators 28 responds to the associated setting signal to operate the mating fuel flow control valve 16*f* to regulate the flow rate of the fuel introduced into the associated control zone. Simultaneously, each of the fuel flow regulators 28 supplies that setting signal received thereby to that air ratio setting device 32 connected thereto. Then each of the air ratio setting devices 32, sets the air ratio permitting the combustion in the associated control zone. Each of the air ratio setting devices 32 supplies the air ratio, thus set, to the mating air flow regulator 30. As a result, each of the air flow regulators 30 actuates the associated air flow control valve 16*a* to regulate a flow rate of air flowing into that burner 12 connected thereto.

From the foregoing it is seen that, according to the last-mentioned aspect thereof, the present invention provides a method of controlling the continuous reheating furnace so that slabs are controlled to the final heated temperature with a high accuracy. This is because, an electronic computer involved predicts the temperatures of the slabs by considering the change relative to time in the temperature profile of the gas within the furnace calculated on the basis of the heating value of a fuel; thereby avoiding the use of the inaccurate gas temperature measurements employed according to the prior art practice as the gas temperature within the furnace, giving the basis on which the slab temperatures are predicted.

While the present has been illustrated and described in conjunction with a few preferred embodiments thereof it is to be understood that numerous changes and modifications may be resorted to without departing from the spirit and scope of the present invention.

What we claim is:

1. A method of controlling a continuous reheating furnace, comprising the steps of sensing the flow rates, at a plurality of time points, of fuel and air introduced into each of a plurality of control zones into which a continuous heating furnace is divided; determining the temperature profile within the furnace up to the present time point by using means for determining a change in the temperature profile within the furnace with respect to time from the sensed flow rates of the thus-introduced fuel and air; finding the temperature of each slab introduced into the furnace at the present time point by using said temperature profile within the furnace determined at the present time point; predicting a future change in the temperature of the furnace on the basis of the thus-determined present temperatures of the slabs and the flow rate of said fuel introduced into each of said control zones, said flow rate set, according to said temperature change determining means; determining the predicted slab temperatures by using said predicted change of said furnace temperature; determining the flow rate of said fuel introduced into each of said control zones so as to render the differences between said predicted slab temperatures and the corresponding objective slab temperatures so as to be not greater than a predetermined value, and controlling the flow rate of said introduced fuel following an objective value based on the flow rate of said fuel so determined.

* * * * *

UNITED STATES PATENT AND TRADEMARK OFFICE

CERTIFICATE OF CORRECTION

PATENT NO. : 4,394,121

DATED : July 19, 1983

INVENTOR(S) : Wakamiya et al.

It is certified that error appears in the above—identified patent and that said Letters Patent is hereby corrected as shown below:

Column 1, next to heading entitled "[76] Inventors:", line 4, delete the entire line, viz., "Japan; Mitsubishi Denki Kabushiki" and replace it by -- Japan. --.

Line 5, next to the same heading, delete in its entirety the line reading "Kaishi, 03, Tokyo, Japan".

Between the heading entitled "[76] Inventors:" and "[21] App. No.: 311,331" please insert the following -- [73] Assignee: Mitsubishi Denki Kabushiki Kaishi, Tokyo, Japan --.

Signed and Sealed this

First Day of November 1983

[SEAL]

*Attest:*

GERALD J. MOSSINGHOFF

*Attesting Officer*

*Commissioner of Patents and Trademarks*